US011536016B2

(12) United States Patent
Schluter

(10) Patent No.: US 11,536,016 B2
(45) Date of Patent: Dec. 27, 2022

(54) FLOOR DRAIN

(71) Applicant: Schluter Systems L.P., Plattsburgh, NY (US)

(72) Inventor: Werner Schluter, Iserlohn (DE)

(73) Assignee: Schluter Systems L.P., Plattsburgh, NY (US)

( * ) Notice: Subject to any disclaimer, the term of this patent is extended or adjusted under 35 U.S.C. 154(b) by 79 days.

(21) Appl. No.: 17/155,490

(22) Filed: Jan. 22, 2021

(65) Prior Publication Data

US 2021/0355671 A1 Nov. 18, 2021

(51) Int. Cl.
*E03F 5/04* (2006.01)

(52) U.S. Cl.
CPC ..... *E03F 5/0408* (2013.01)

(58) Field of Classification Search
CPC ..... E03F 5/0408; E03F 5/0407
USPC ..... 4/612
See application file for complete search history.

(56) References Cited

U.S. PATENT DOCUMENTS

| | | | | |
|---|---|---|---|---|
| 5,022,430 | A | 6/1991 | Degooyer | |
| 5,458,769 | A | 10/1995 | Johannessen | |
| 6,298,621 | B1 | 10/2001 | Lee | |
| 6,905,285 | B2 | 6/2005 | Little et al. | |
| 7,246,472 | B2 | 7/2007 | Nielsen | |
| 7,472,719 | B2 | 1/2009 | Dallmer | |
| 7,617,644 | B2 | 11/2009 | Neilsen | |
| 9,127,446 | B2 | 9/2015 | Schlueter | |
| 9,334,638 | B1 * | 5/2016 | Kirby | A47K 3/40 |
| 9,567,739 | B2 | 2/2017 | Nyce | |
| 9,611,634 | B2 | 4/2017 | Erlebach | |
| 9,644,363 | B2 | 5/2017 | Meyers | |
| 10,017,933 | B1 | 7/2018 | Kirby | |
| 10,105,017 | B2 | 10/2018 | Clear et al. | |
| 10,106,970 | B2 | 10/2018 | Plank et al. | |
| 2011/0047695 | A1 * | 3/2011 | Niedens | E03F 5/04 4/679 |
| 2011/0067175 | A1 | 3/2011 | Steylaerts et al. | |
| 2012/0198778 | A1 | 8/2012 | MacLean et al. | |
| 2013/0061387 | A1 | 3/2013 | Stetson et al. | |
| 2013/0318704 | A1 | 12/2013 | Plank | |
| 2014/0259371 | A1 * | 9/2014 | Schaffer | A47K 3/405 4/613 |
| 2014/0352815 | A1 | 12/2014 | Brodey et al. | |
| 2018/0038091 | A1 * | 2/2018 | Ismert | E03F 5/0401 |

(Continued)

FOREIGN PATENT DOCUMENTS

DE 202010002763 U1 7/2011

*Primary Examiner* — Huyen D Le
(74) *Attorney, Agent, or Firm* — Jason Jones

(57) ABSTRACT

A floor drain includes a channel body defining a longitudinal direction and including two outflow channels which extend parallel to each other, each having a channel bottom and two channel walls. A connecting bar extends horizontally and connects the upper mutually facing longitudinal edges of the channel walls. An outflow opening interrupts the connecting bar and the channel walls directly connected thereto. An outflow fitting is arranged below the channel body and surrounds the outflow opening in the circumferential direction. At least one slat-like connecting element is detachably mounted on the channel body and is designed in such a way that it continues the connecting bar and the channel walls in the region interrupted by the outlet opening.

20 Claims, 13 Drawing Sheets

(56) References Cited

U.S. PATENT DOCUMENTS

| | | | |
|---|---|---|---|
| 2018/0238040 | A1 | 8/2018 | Grant |
| 2018/0340319 | A1 | 11/2018 | Schulter |

* cited by examiner 1
16
14
24
3

FLOOR DRAIN

PRIORITY CLAIM

Priority is claimed of and to German Patent Application Serial No. DE 20 2020 100 376.3, filed Jan. 24, 2020, which is hereby incorporated herein by reference in its entirety.

BACKGROUND OF THE INVENTION

Field of the Invention

The present invention relates to a floor drain which can be used, in particular, in the construction of flush-with-floor showers.

Related Art

As used below, the terms "top", "bottom", "horizontal", and "vertical" refer to the installation state of the floor drain.

Floor drains are known in principle in the prior art. For example, DE 20 2010 002 763 U1 describes a floor drain which has a base body, a channel body, a frame and a cover. The base body is an elongated and substantially rectangular block made of foamed plastic, such as expanded polystyrene. The base body comprises a longitudinally extending, groove-like and upwardly open recess, which is used to receive a waste pipe and in the upper region is designed for the substantially form-fitting reception of the channel body. The channel body is made of sheet metal, for example of aluminum or stainless steel sheet. Alternatively, it can also be made of plastic. It forms a single outflow channel which is centrally provided with an outflow opening to which the waste pipe to be received by the base body can be connected. The outflow channel is enclosed by an outflow channel flange, the underside of which in the mounted state of the floor drain rests on the upper side of the base body. The frame, made of sheet metal such as aluminum or stainless steel sheet, has substantially vertically extending side walls arranged in a frame configuration and which together form a receiving opening. A substantially horizontally extending frame flange, which encloses the receiving opening like a frame and is bent downwards at the free end, adjoins the upper edges of the side walls. Projections projecting into the receiving opening are provided on opposite side walls and form a receptacle for the cover to be inserted into the frame from above. On the upper side, the cover is provided with a plurality of through-holes for draining water into the channel body. In principle, such through-holes can also be dispensed with. In this case, the cover must be made somewhat narrower and be laterally distanced from the side walls of the frame by means of spacers, so that lateral drainage slots are created through which the water to be discharged can pass in the direction of the channel body.

One problem of such a floor drain is that together with the base body, channel body, frame and cover it has a multiplicity of components, which is production-intensive and cost-intensive.

SUMMARY OF THE INVENTION

Taking this prior art as a point of departure, it is an object of the present invention to provide a floor drain with a simplified structure.

To achieve this object, in one aspect, the present invention provides a floor drain having a channel body defining a longitudinal direction and comprising two outflow channels which extend parallel to each other, each having a channel bottom and two channel walls; a connecting bar extending horizontally and connecting the upper mutually facing longitudinal edges of the channel walls; and an outflow opening that interrupts the connecting bar and the channel walls directly connected thereto; having an outflow fitting arranged below the channel body and circumferentially enclosing the outflow opening; and a slat-like connecting element detachably mountable on the channel body and designed in such a way that it continues the connecting bar and the channel walls in the area interrupted by the outflow opening. A significant advantage of the floor drain according to the invention compared with the floor drain disclosed in document DE 20 2010 002 763 U1 is that a cover which covers the outflow channel substantially completely and thus also a frame receiving such a cover are dispensed with. Accordingly, the floor drain according to the invention is of a simple and inexpensive design having only a few individual components. Thanks to the connecting element detachably mounted on the channel body, the outflow opening can be made accessible at any time in order, for example, to clean it or to clear blockages.

According to one embodiment of the present invention, the channel body is formed in one piece, which gives it good stability. In addition, there is also no need to assemble the channel body.

The channel body preferably comprises metal, in particular aluminum or stainless steel. In principle, however, the channel body can also comprise other materials, for example plastic.

The channel body is advantageously manufactured from an extruded profile, that is to say, from a profile with a constant cross-section. Deviations from this constant cross-section in the form of the outflow opening and the interruption in the connecting bar associated with the production of the outflow opening and of the channel walls directly connected thereto are introduced in particular by the use of machining processes, preferably using a milling tool.

The channel body preferably has precisely two outflow channels, which results in a simple structure.

The outflow channels advantageously have a maximum width of 8 mm in order to prevent injury to a person stepping on the channel body.

According to one embodiment of the present invention, a horizontally extending boundary bar adjoins each of the longitudinal edges of the outer channel walls of the channel body, whereby a visually very pleasing appearance is realized. Furthermore, space can be created alongside the outer outflow channels for attaching further components of the floor drain and also space for anchoring mortar, tile adhesive or the like.

The boundary bars advantageously have the same height and/or width as the connecting bar, which is conducive both to visual appearance and to reduction of the risk of injury due to the channel body.

The outer longitudinal sides of the boundary bars are preferably provided with downward-facing side bars which form outer side faces of the channel body.

Advantageously, inwardly facing end bars adjoin the side bars in such a way that the undersides of an outer channel wall, a boundary bar, a side bar and an end bar form a recess in each case which is accessible from the end and from below.

According to one embodiment of the present invention, end pieces which bound the outflow channels at the ends are attached to the channel body at the ends of the channel body. In this way, an end closure is achieved. The width of the end pieces corresponds in particular to the width of the connecting bar and/or the boundary bar, as a result of which a very uniform appearance is achieved.

Each end piece can be provided with two projections projecting in the direction of the channel body, which projections are positioned and formed in such a way that at their ends they engage in the recesses of the channel body. In this way, a desired alignment of the end pieces relative to the channel body is ensured.

The end pieces can advantageously be screwed onto the channel body, as a result of which a simple and inexpensive fastening is realized.

The connecting element can have an upper side which terminates flush with the upper side of the connecting bar, and the connecting element preferably has outer side faces which terminate flush with the channel walls.

The connecting element can advantageously be inserted from above into the channel body in a form-fitting manner, as a result of which a simple fastening is realized.

According to one embodiment of the present invention, the outflow fitting can be formed in one piece, in particular from plastic, which results in an inexpensive component.

Two oppositely arranged fastening tongues projecting outwards in the longitudinal direction can be provided in the upper region of the outflow fitting, said fastening tongues having through-holes through which fastening screws screwed into the channel body extend.

Receiving projections can advantageously be provided which project upward from the fastening tongues and engage in recesses provided on the underside of the connecting element and formed congruously to the receiving projections.

In the upper region of the outflow fitting, oppositely arranged positioning elements can extend in the longitudinal direction and in each case can project outwards in the transverse direction and upwards are advantageously provided which are designed such that they engage in recesses of the channel body accessible from the underside of the channel body, in particular in recesses of the previously described type. In this way, secure fastening and proper alignment of the outflow fitting on the channel body are ensured in a simple manner.

In one exemplary embodiment of the technology, a floor drain installation includes a subfloor surface having an opening formed therethrough. A drain flange can be supported above the subfloor, with at least a portion of the drain flange extending through the opening in the subfloor surface and being connectable to a drainage pipe therebelow. A flange support assembly can be disposed beneath and can support the drain flange. A shower pan tray can substantially circumscribe the flange support assembly. A waterproofing membrane can extend over the shower pan tray and at least partially over upper surfaces of the drain flange. A channel body can have a bottom surface, the bottom surface of the channel body extending across the waterproofing membrane. The channel body can define a longitudinal direction having an outflow opening formed in a bottom thereof. The outflow opening can be positioned above the opening formed through the subfloor. An outflow fitting can be arranged below the channel body and can fluidly couple the channel body with the drainage flange.

In accordance with another aspect of the technology, a method of installing a floor drain assembly is provided. The method can include positioning a drain flange support assembly beneath a drain flange. The drain flange and support assembly can be positioned atop an opening formed through a subfloor, with the drain flange being connectable through the opening to a drainage pipe. The method can include at least partially circumscribing the drain flange support assembly with a shower pan tray and installing waterproofing membrane across the shower pan tray such that the waterproofing membrane extending at least partially across upper surfaces of the drain flange. An outflow fitting can be positioned in fluid communication with an outflow opening formed in a channel body. A bottom surface of the channel body can be positioned above an upper surface of the waterproofing membrane such that the channel body extends outwardly from the drain flange and above the waterproofing membrane and the shower pan tray. A debris screen can be positioned within the channel body over the outflow opening in the channel body.

Further features and advantages of the present invention will become apparent from the following description of a floor drain according to an embodiment of the present invention with reference being made to the accompanying drawings. These show

BRIEF DESCRIPTION OF THE DRAWINGS

FIG. 6 is a top, plan view of the floor drain;

FIG. 7 is an underside view of the floor drain;

DETAILED DESCRIPTION

Figure 1:
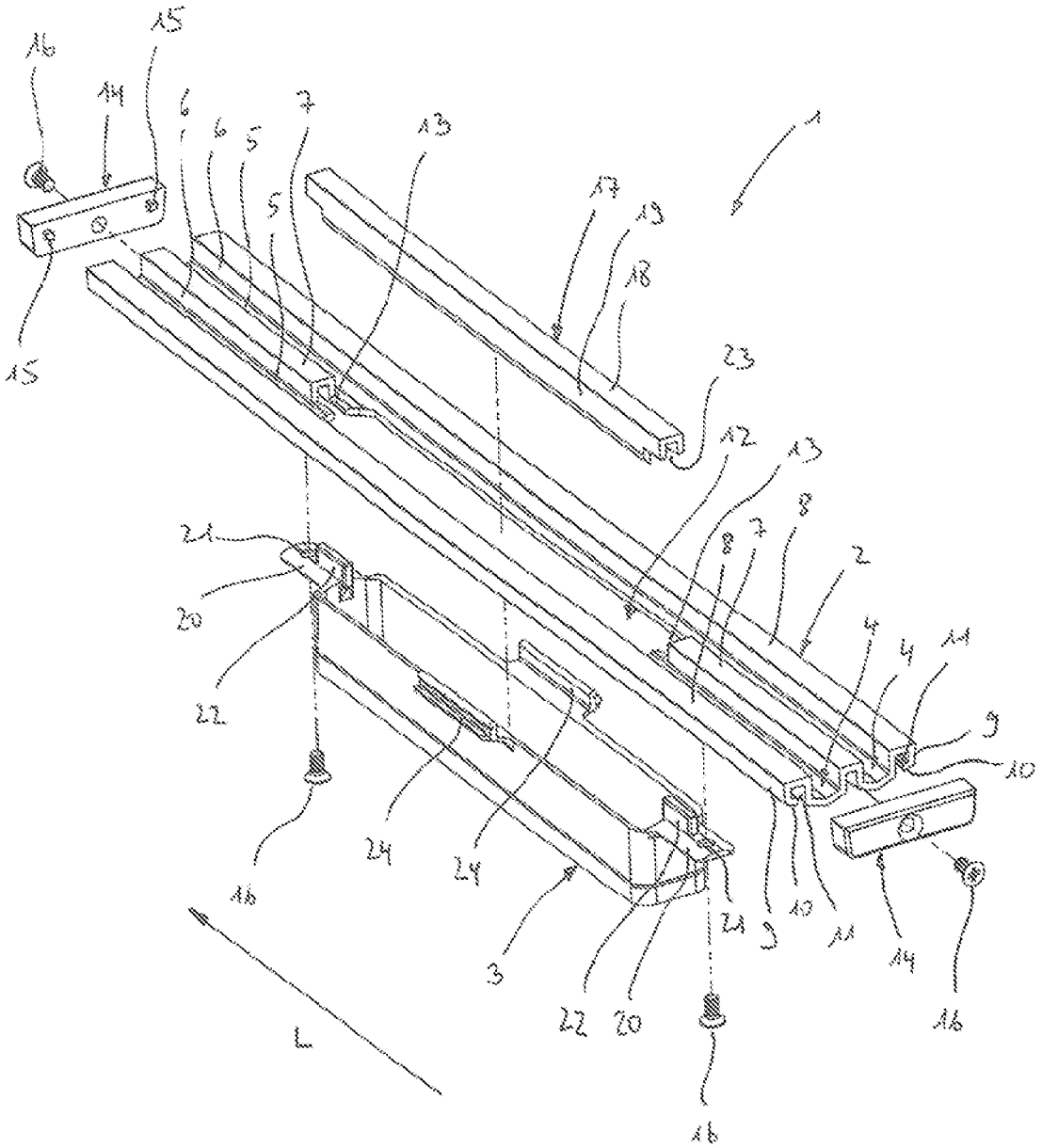
FIG. 1 is an exploded perspective view of a floor drain according to an embodiment of the present invention.
Figure 2:
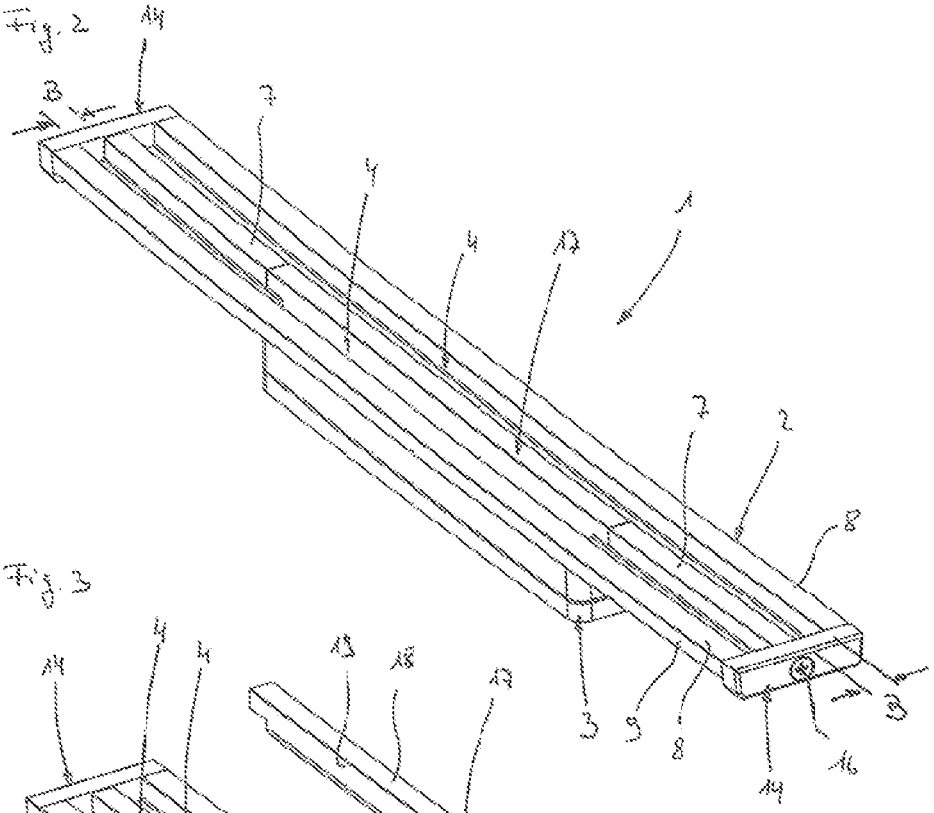
FIG. 2 is a perspective view of the floor drain.
Figure 3:
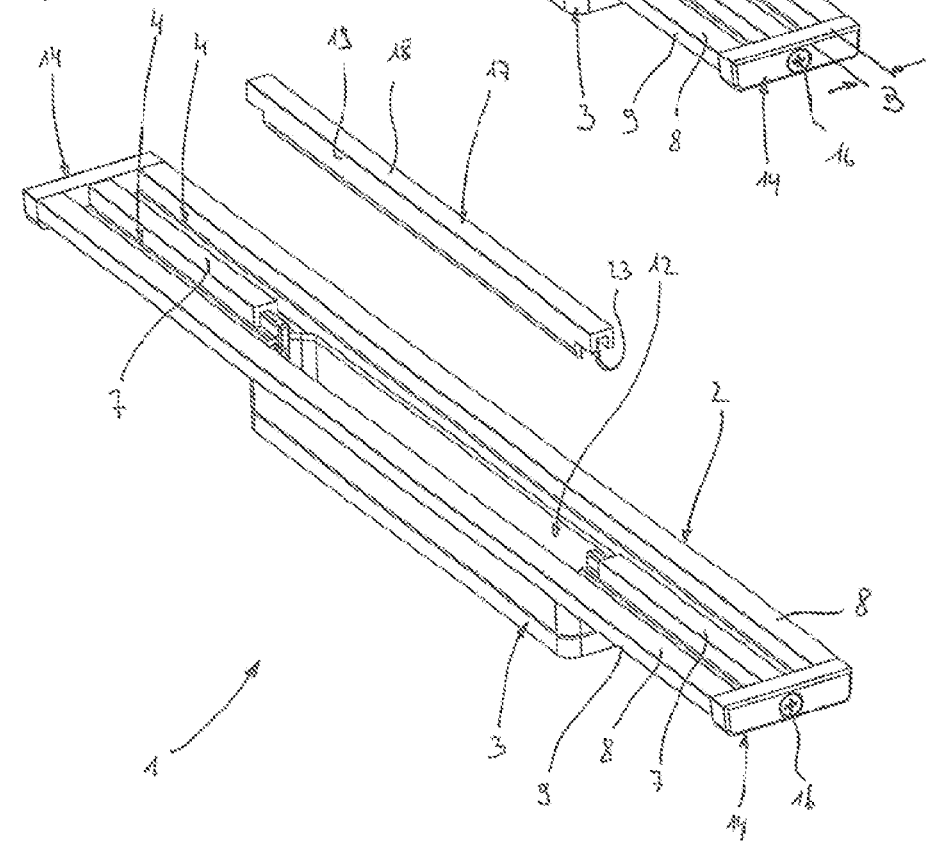
FIG. 3 is a perspective view of the floor drain with a connecting element shown raised.
Figure 3:
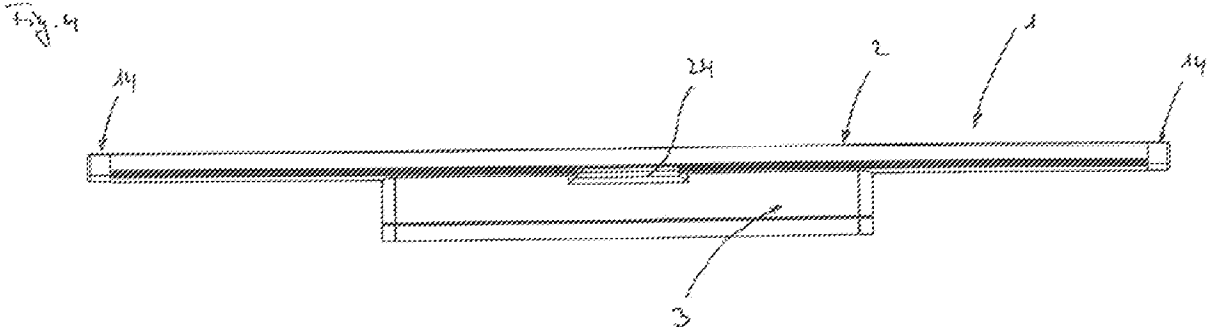
Figure 5:
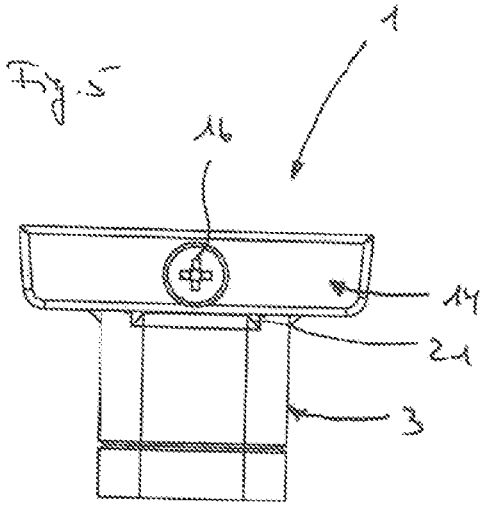
FIG. 5 is an end view of the floor drain.
Figure 3:
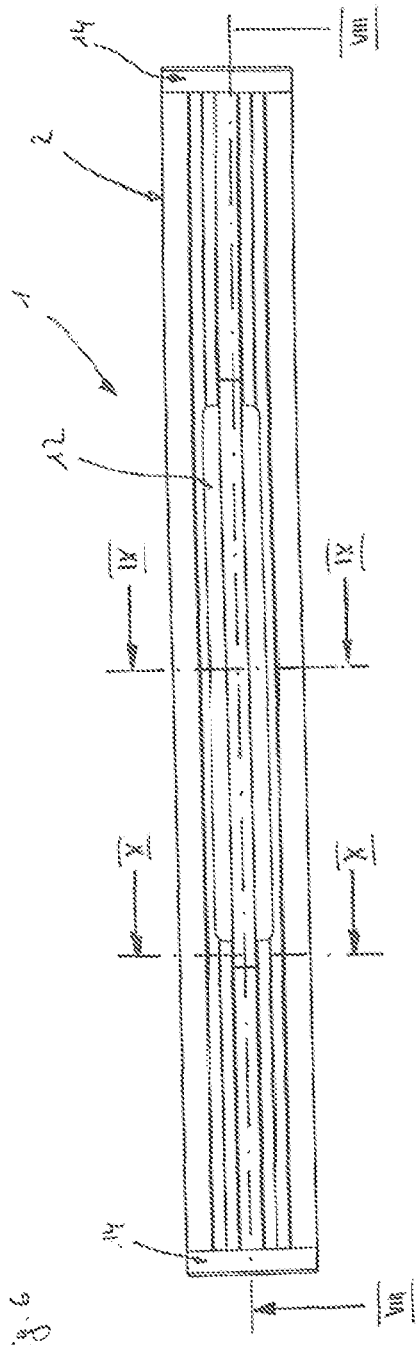
Figure 4:
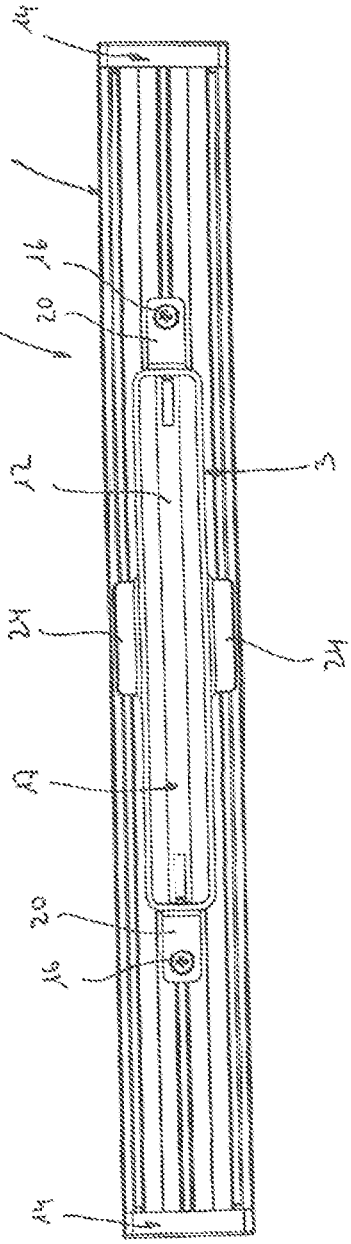
FIG. 4 is a side view of the floor drain.
Figure 8:
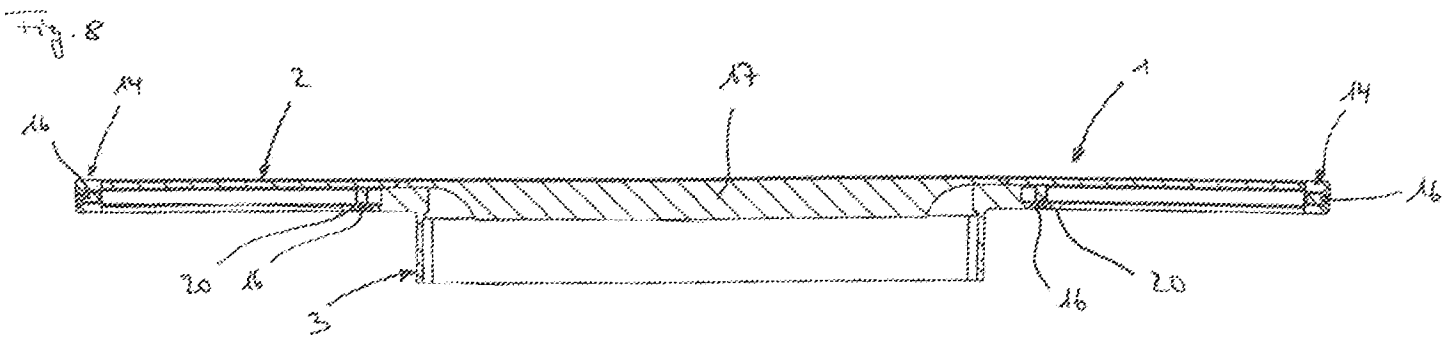
FIG. 8 is a sectional view along the line VIII-VIII in FIG. 6.
Figure 9:
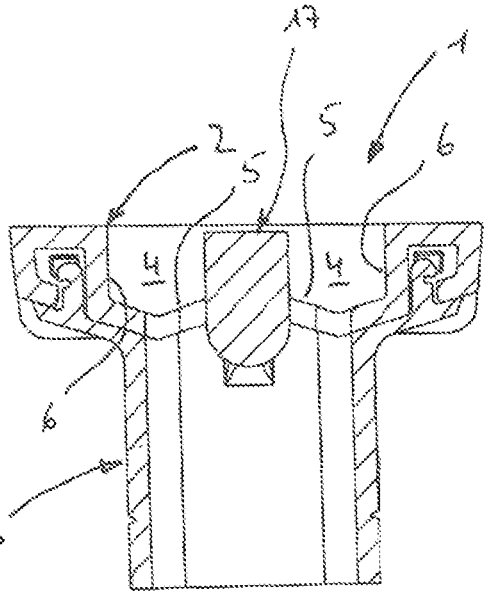
FIG. 9 is a sectional view along the line IX-IX in FIG. 6.
Figure 10:
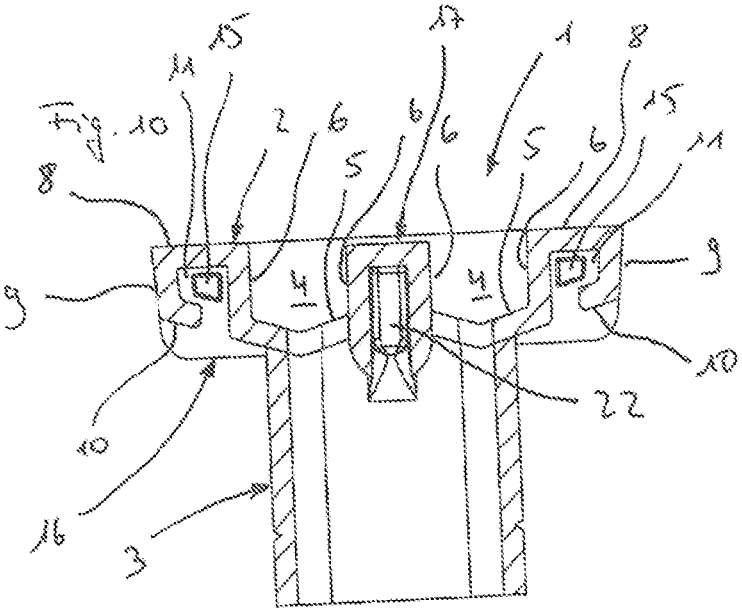
FIG. 10 is a sectional view along the line X-X in FIG. 6.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a body" can include one or more of such bodies, if the context dictates.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

INVENTION

FIGS. 1 to 10 show a floor drain 1 according to a first embodiment of the present invention, which has a channel body 2 and an outflow fitting 3 as its main components.

The channel body 2 extends in a longitudinal direction L. In the present case, it is made in one piece from an aluminum extruded profile with a constant cross-section. In principle, however, other materials are also possible, in particular other metals, for example stainless steel. The channel body 2 comprises two outflow channels 4 which extend parallel to each other, each having a channel bottom 5 formed in a V-shape in the present case and two channel walls 6. The widths B of the outflow channels 5 are selected to correspond to each other and not to exceed 8 mm. The upper mutually facing longitudinal edges of the channel walls 6 are connected to each other by a horizontally extending connecting bar 7, the width of which preferably corresponds to the width B of the outflow channels 4.

A horizontally extending boundary bar 8 is connected in each case to the longitudinal edges of the outer channel walls 6, the width of which preferably likewise corresponds to the width B of the outflow channels 4. In the present case, the boundary bars 8 and the connecting bar 7 are arranged in a common horizontal plane, so that the channel body 2 has a flat surface. The outer longitudinal sides of the boundary bars 8 are adjoined by downward-facing side bars 9 which form the outer side faces of the channel body 2. Inwardly facing end bars 10 in turn adjoin the side bars 9 in such a way that in each case the undersides of an outer channel wall 6, a boundary bar 8, a side bar 9 and an end bar 10 form a recess 11 which is accessible from the end and from below. In the present case, a longitudinal outflow opening 12 is provided centrally in the channel body 2, which interrupts the connecting bar 7 and the channel walls 6 directly connected thereto.

In the present case, the outflow opening 12 was introduced into the extruded profile during the manufacture of the channel body 2 using a milling cutter. In the course of this machining, short sections of the channel walls 6 adjacent to the outflow opening 12 and of the connecting bar 7 were also removed at the positions 13.

Substantially rectangular end pieces 14 are fastened to the end faces of the channel body 2 and bound the outflow channels 4 at the ends. Each end piece 14 is provided with two projections 15 projecting in the direction of the channel body 2 which are positioned and formed in such a way that at the ends they engage in the recesses 11 of the channel body 2. The end pieces 14 are screwed to the channel body 2 using fastening screws 16. The upper sides of the end pieces 14 terminate flush with the upper sides of the connecting bar 7 and the boundary bars 8. The width of the end pieces 14 corresponds in the present case to the width B of the connecting bar 7. A debris screen in the form of a slat-like connecting element 17 can be detachably mounted on the channel body 2 is designed in such a way that it continues the connecting bar 7 and the channel walls 6 in the region interrupted by the outflow opening 12. An upper side 18 of the connecting element 17 here terminates flush with the upper side of the connecting bar 7. The outer side faces 19 of the connecting element 17 also terminate flush with the channel walls 6.

The outflow fitting 3 is produced in the present case as a single-piece injection-molded plastic part. It is arranged below the channel body 2 and surrounds the outflow opening 12 circumferentially. The outflow fitting is formed in one piece, in particular from plastic. In the upper region of the outflow fitting 3, two oppositely arranged fastening tongues 20 projecting outwards in the longitudinal direction L are provided which have through-holes 21 through which fastening screws 16 screwed to the channel body 2 extend. Receiving projections 22 are provided on the fastening tongues 20 and project upwardly from the fastening tongues 20 and engage in recesses 23 that are provided on the underside of the connecting element 17 and are formed congruously to the receiving projections 22. In the upper region of the outflow fitting 3 there are also oppositely arranged positioning elements 24 extending in the longitudinal direction L and in each case projecting outwards in the transverse direction and upwards and designed such that they engage in the recesses 11 of the channel body 2 which are accessible from the underside of the channel body 2; see in particular FIG. 9.

Figure 11:
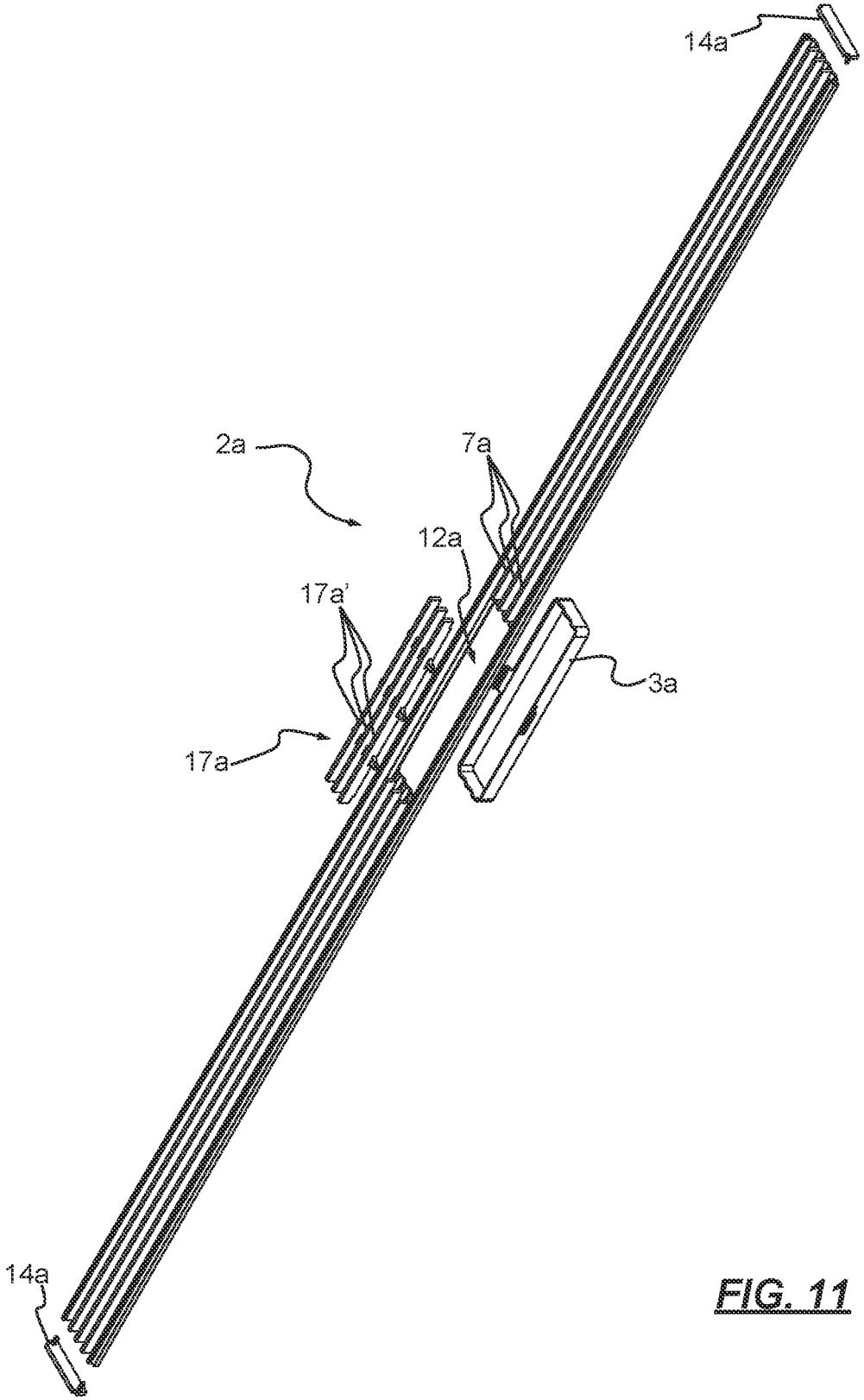
FIG. 11 is an exploded perspective view of a floor drain system in accordance with another aspect of the technology.

FIGS. 11 through 18 illustrate further embodiments of the technology. FIG. 11 illustrates an additional embodiment in which channel body 2*a* includes a debris screen in the form of a slat-like connecting element assembly 17*a*. This debris screen is similar to the connecting element 17 shown in FIGS. 1-3, 6, 7, and 8, except that this assembly includes a plurality of connecting elements 17*a*' coupled together to form an assembly. The connecting element assembly is carried by the channel body 2*a* in much the same manner, and is generally removably fittable within the channel body over the outflow fitting. The channel body 2*a* includes a plurality of connecting bars 7*a* that correspond to the connecting elements 17*a*' of the connecting element assembly 17*a*. The profiles (e.g., upper and side surfaces) of the connecting elements match those of the connecting bars 7*a* of the channel body. Thus, when viewed with a casual eye, the connecting bars appear to constitute a continuous structure that extends along the entirety of the drain channel. The connecting element assembly can be removably fittable within the channel body over the outflow fitting. As such, it can easily be removed to allow access to the outflow fitting 3*a* beneath to allow cleaning of debris.

Figure 12A:
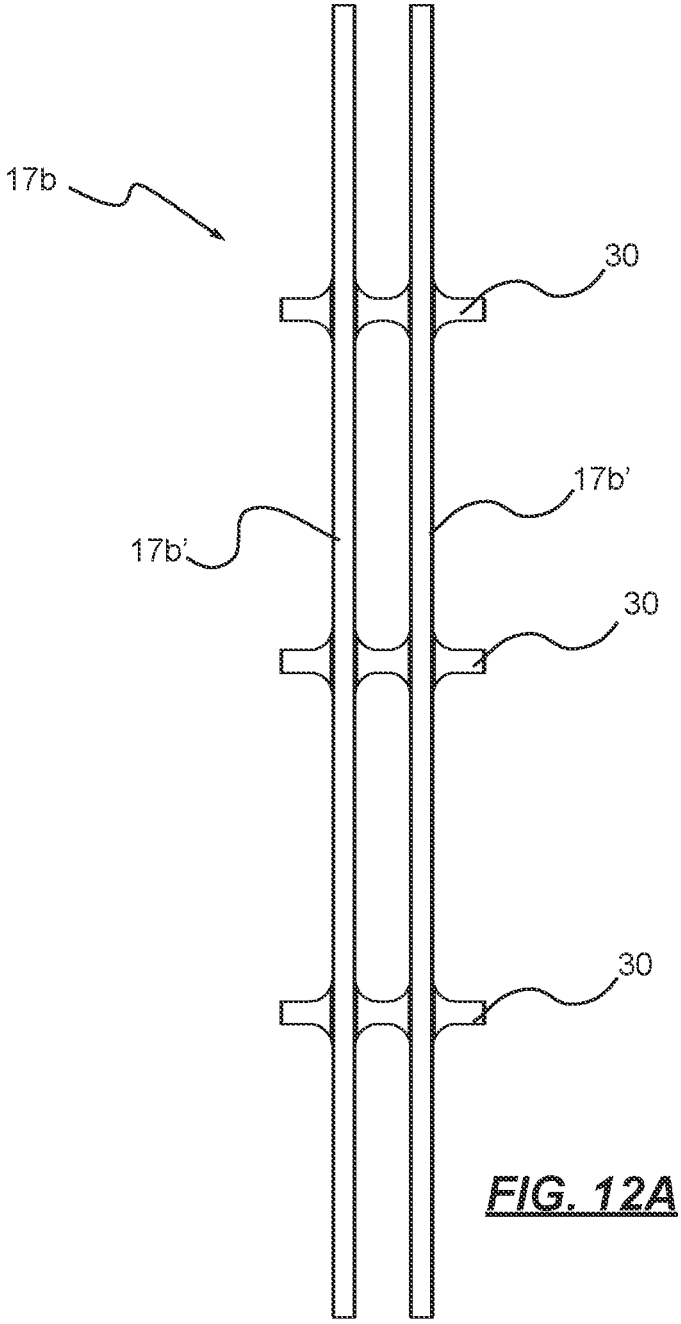
FIG. 12A is a top view of a slat-like connecting element assembly in accordance with an aspect of the technology.
Figure 12B:
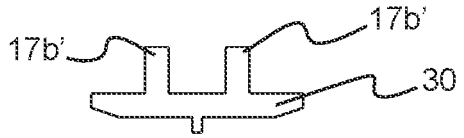
FIG. 12B is an end view of the connecting element assembly of FIG. 12A.

FIGS. 12A and 12B illustrate an alternate slat-like connecting element assembly 17*b* that includes two slat-like connecting elements 17*b*'. The elements can be connected into an assembly in much the same manner as connecting elements 17*a*', in this case by way of connecting rods 30 that maintain the spacing and configuration of the assembly.

The one-, two- and three-slat embodiments shown herein are merely exemplary—any number of slats can be combined to form the debris screen and can correspond accordingly to a varied number of connecting bars in the channel body.

Figure 13A:
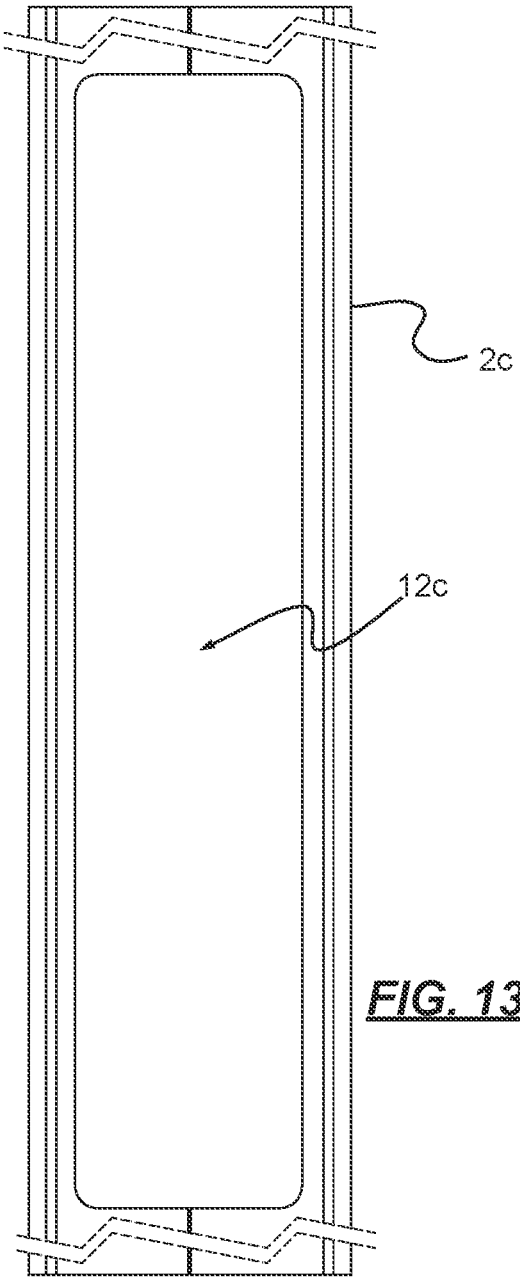
FIG. 13A is a top view of a channel body in accordance with an aspect of the technology, with portions of the length omitted to show details more clearly.
Figure 13B:
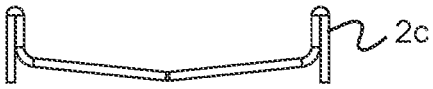
FIG. 13B is an end view of the channel body of FIG. 13A.
Figure 14A:
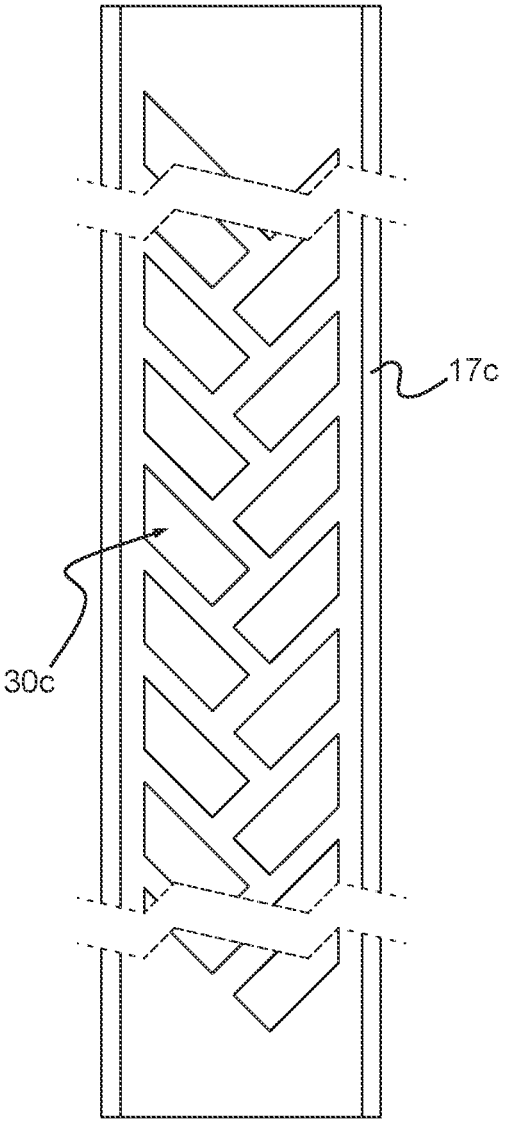
FIG. 14A is a top view of a drain grate that can be fitted into the channel body of FIGS. 13A and 13B, with portions of the length omitted to show details more clearly.
Figure 14B:
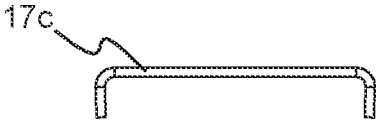
FIG. 14B is an end view of the drain grate of FIG. 14A.

FIGS. 13A and 13B illustrates an alternate channel body 2*c* that is devoid of connecting bars. Instead, drain grate 17*c* (FIGS. 14A and 14B) fits within the channel body to provide the appearance of a standard drain grate assembly. As will be appreciated, openings 30*c* can be formed in the drain grate to provide the debris screen function. Opening 12*c* can be positioned over a suitable outflow fitting (not shown) and function in much the same manner described above. Note that these are sectional views: large portions of the drain channel 2*c* and drain grate 17*c* are omitted from these views to clearly illustrate the features thereof. The drain channel and drain grate are generally much longer than they are wide, similar in scale to those examples shown in FIG. 11.

Figure 15:
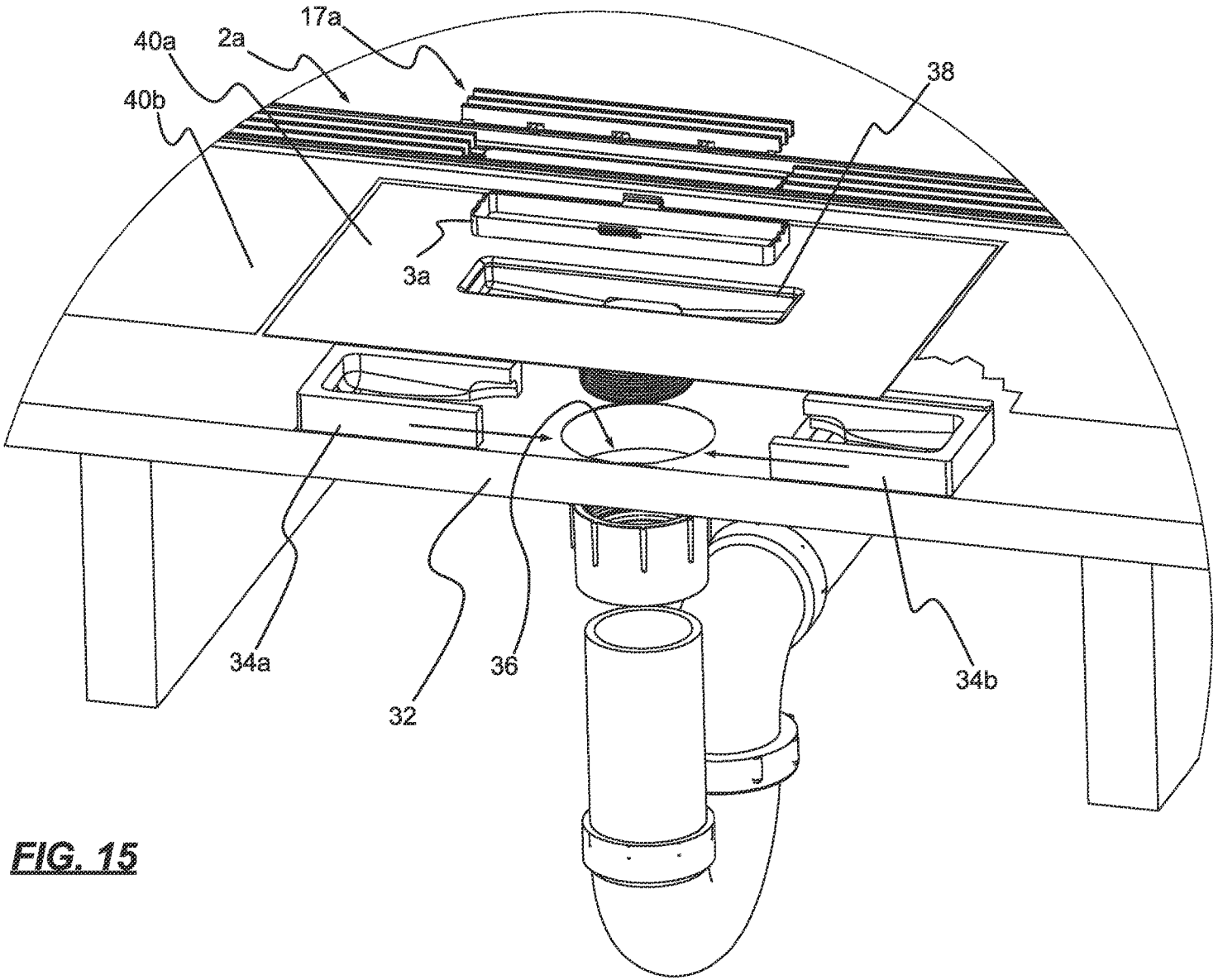
FIG. 15 is an exploded, perspective of a drain installation in accordance with an embodiment of the technology. Note that not all components are shown in this view, and some are shown only partially.
Figure 16:
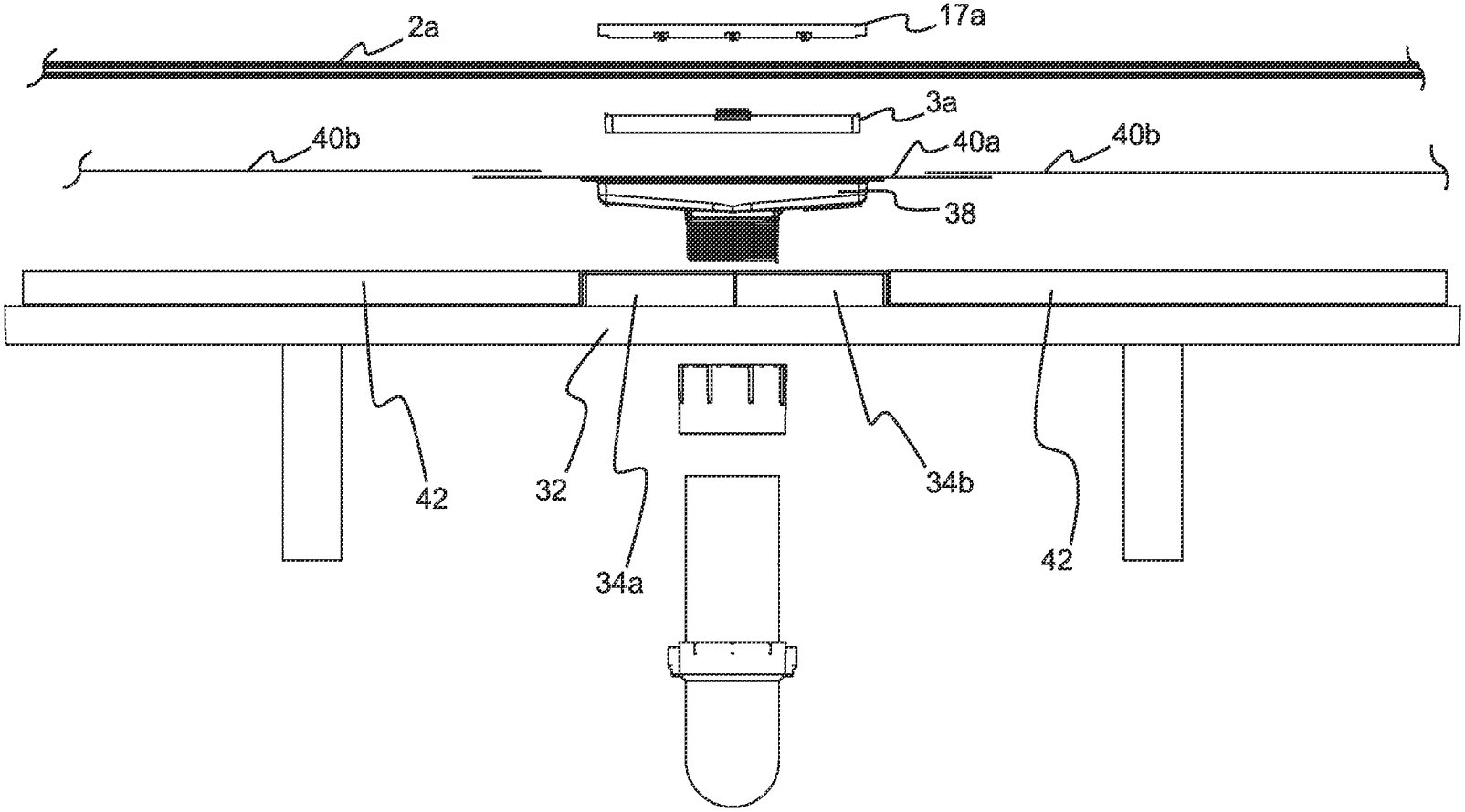
FIG. 16 is an exploded, side view of the drain installation of FIG. 15.
Figure 17:
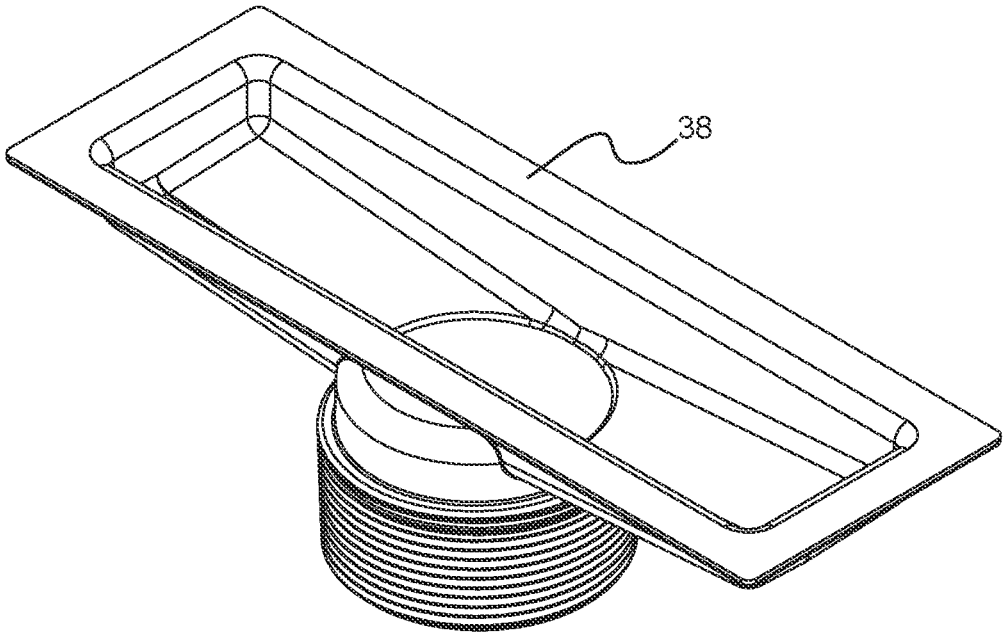
FIG. 17 is a perspective view of an exemplary drain flange in accordance with an embodiment of the technology.
Figure 18:
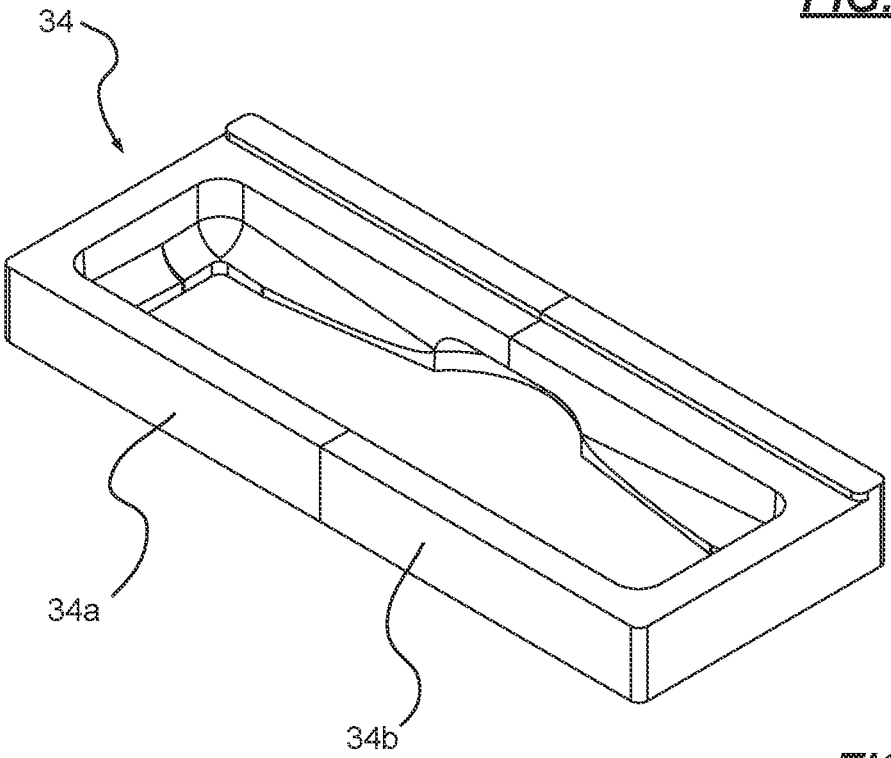
FIG. 18 is a perspective view of an exemplary flange support assembly in accordance with an embodiment of the technology.

FIGS. 15 and 16 illustrate an exemplary floor drain installation utilizing the technology discussed above. While this example is discussed as applied to a conventional shower floor installation, it is to be understood that the present technology can be utilized in a variety of drainage applications aside from showers. It is noted that some features shown in FIG. 16 are omitted from FIG. 15 in the interest of clarity. In addition, two sections of waterproofing membrane 40*a*, 40*b* are shown in FIG. 15 as abutting one another. In practice, these sections of waterproofing membrane will overlap one another. The view included in FIG. 15 is altered to more clearly show all of the components.

As will be appreciated by those of ordinary skill in the art, in a typical installation, a subfloor 32 is generally supported by conventional floor joists. A drainage pipe (e.g., gooseneck or P-trap) provides drainage to the building drain system. An opening 36 can be formed through the subfloor to provide access between the drain installation and the drainage system. A drain flange 38 (also shown in more detail in FIG. 17) can be supported above the subfloor, with at least a portion of the drain flange extending through the opening in the subfloor surface and being connectable to the drainage pipe therebelow.

A flange support assembly 34 (also shown in more detail in FIG. 18, in this example comprised of segments 34*a*, 34*b*) can be disposed beneath the drain flange 38 to provide support for the drain flange. A shower pan tray 42 (omitted from FIG. 15 for clarity), or similar tray support structure, can substantially circumscribe the flange support assembly. A waterproofing membrane 40*a*, 40*b* can extend over the shower pan tray and at least partially over upper surfaces of the drain flange. A channel body 2*a* can define a longitudinal direction having an outflow opening (12*a* in FIG. 11) formed through a bottom thereof. A bottom surface of the channel body can extend across the waterproofing membrane. This outflow opening can be positioned above the opening formed through the subfloor. An outflow fitting 3*a* can be arranged below the channel body to fluidly couple the channel body with the drain flange.

During a typical installation, flange support assembly 34 can firstly be installed beneath (and around portions of) the drain flange 38. In the example shown, the support assembly includes segments 34*a*, 34*b* that are mated with one another around a portion of the drain flange from sides of the drain flange. This assembly can then be positioned on the subfloor 32 and the drain flange can be connected to the p-trap through opening 36 through the subfloor. Prior to this, or immediately thereafter, shower pan tray 42 can be positioned about the drain flange support and can substantially completely circumscribe the drain flange support assembly. Waterproofing membrane 40*a* can be formed as a collar about upper surfaces of the drain flange and can be provided to a consumer already bonded or sealed to the drain flange. Waterproofing membrane 40*b* can then be attached to the shower pan tray in the normal fashion, and also sealed to the membrane 40*a* to create a watertight layer across the entirety of the floor and walls (where applicable).

Channel body 2*a* can then be placed atop waterproofing membrane 40*a*, 40*b* and secured in position. At this point, outflow fitting 3*a* is aligned with outflow opening 12*a*, both of which are aligned with the drain flange 38. Thus, any water that enters the channel body will flow toward the center of the body, through the outflow opening 12*a* into the outflow fitting 3*a*, through the drain flange and into the drainage system below. Debris screen 17*a* can be positioned above the drain flange to prevent large pieces of debris from entering the drainage system. Tiles (not shown) can be installed in the normal manner around and abutting all sides and ends of the drain channel.

It will be appreciated that the waterproofing layer of the installation is below the channel body 2*a*: as such, strictly requiring waterproofing within the drain channel (particularly on the ends of the drain channel) is not as critical as in conventional drain installations. This is due to the fact that, if water travels beneath the channel body, it is directed toward the drain over the top of the waterproofing membrane 40*a*, 40*b*. Thus, while some embodiments include end caps, they are not necessary in all embodiments to provide a watertight seal, as the grout immediately next to the end caps is intended to receive water in any case. Similarly, while the channel bodies taught herein are generally watertight along their bottom surface, they needn't necessarily be completely watertight, as water will be directed by the underlying waterproofing membrane should be present beneath the channel body.

Another advantage of the present technology is that a relative length of the channel body on either side of the outflow opening is completely independent of the subfloor and show tray structure. For example, while the embodiment shown in FIG. 16 includes generally equal lengths of channel body on each side of the drain fitting, such need not be the case. One side can be cut significantly shorter than another and the drain system will still function properly. As the channel bodies shown herein can be formed in an extrusion process, an installer may purchase a drain body of sufficient length to allow him or her to install the channel body with a drain opening offset of several feet. In other words, the channel body need not be designed and purchase for an exact fit: the installer may cut lengths of the drain channel to optimize installation to a particular structure.

As an arbitrary example, assume a shower wall or opening at which a drain is to be installed is six feet in length. As is sometimes the case, the p-trap may not be centered within this six foot span. Thus, assuming the p-trap is located two feet from one end of the drain installation and four feet from another end. Using a conventional drain system, an installer would likely have to move the p-trap one foot in order to center it within the drain installation. This is because most commercially available drains are centered about the drain opening. Using the present system, however, an installer could be provided with a drain channel eight feet in length. The installer could cut the drain channel such that two feet extend in one direction from the outlet opening and four feet in the other direction from the outlet opening. The resulting drain channel would properly span the six foot installation, with the outlet properly positioned above the p-trap, without having to modify the drain plumbing to accommodate the drain position. This process can of course be extrapolated to any number of variations that an installer may experience in the field. This flexibility is not provided by conventional drains, as segmenting them would render the useless for containing water flow.

In addition to the structure outlined above, the present technology also provides a method of installing a floor drain assembly. The method can include positioning a drain flange support assembly beneath a drain flange, and positioning the drain flange and support assembly atop an opening formed through a subfloor. The drain flange can be connectable through the opening to a drainage pipe. The method can include at least partially circumscribing the drain flange support assembly with a shower pan tray. Waterproofing membrane can be installed across the shower pan tray, the waterproofing membrane extending at least partially across upper surfaces of the drain flange. An outflow fitting can in positioned in fluid communication with an outflow opening formed in a channel body. A bottom surface of the channel body can be positioned above an upper surface of the waterproofing membrane such that the channel body extends outwardly from the drain flange and above the waterproofing membrane and the shower pan tray. A debris screen can be positioned within the channel body over the outflow opening in the channel body.

Positioning the debris screen can include positioning a slat-like connecting element assembly adjacent one or more connecting bars carried by the channel body. Positioning the debris screen can include positioning an elongate drain grate within the channel body, the drain grate extending along substantially an entire length of the channel body. Installing waterproofing membrane can include sealing a sheet of waterproofing membrane to a collar of waterproofing membrane carried by the drain flange. Positioning the drain flange support assembly can include mating at least two drain flange support assembly components around a portion of the drain flange.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

LIST OF REFERENCE NUMBERS

1 Floor drain
2, 2*a*, 2*c* Channel body
3, 3*a* Outflow fitting
4 Outflow channel
5 Channel floor
6 Channel wall
7, 7*a* Connecting bar
8 Outer bar
9 Side bar
10 End bar
11 Recess
12, 12*a*, 12*c* Outflow opening
13 Position
14, 14*a* End piece
15 Projection
16 Fastening screw
17, 17*a*, 17*a*' Debris screen—Connecting element
17*b*, 17*b*', 17*c*
18 Upper side
19 Side face
20 Fastening tongue
21 Through-hole
22 Receiving projection
23 Recess
24 Positioning element
L Longitudinal direction
B Width
30*c* Through-hole
32 Subfloor
34, 34*a*, 34*b* Flange support assembly
36 Through-hole
38 Drain flange
40*a*, 40*b* Waterproofing membrane
42 Shower pan tray

I claim:

1. A floor drain, comprising:

a channel body defining a longitudinal direction and comprising at least two outflow channels which extend parallel to each other, each having a channel bottom and two channel walls; a connecting bar extending horizontally and connecting the upper mutually facing longitudinal edges of the channel walls; and an outflow opening that interrupts the connecting bar and the channel walls directly connected thereto, an outflow fitting arranged below the channel body and surrounding the outflow opening in the circumferential direction, and at least one slat-like connecting element which is detachably mounted on the channel body and is designed in such a way that it continues the connecting bar and the channel walls in the region interrupted by the outlet opening.

2. The floor drain according to claim 1, wherein the channel body is formed in one piece.

3. The floor drain according to claim 1, wherein the channel body is made from an extruded profile.

4. The floor drain according to claim 1, wherein the channel body has more than two outflow channels.

5. The floor drain according to claim 1, wherein one of a pair of horizontally extending boundary bars adjoins each of the longitudinal edges of the outer channel walls of the channel body.

6. The floor drain according to claim 5, wherein the boundary bars have the same height and/or the same width as the connecting bar.

7. The floor drain according to claim 1, wherein the connecting element has an upper side which terminates flush with the upper side of the connecting bar and that the connecting element has outer side faces which terminate flush with the channel walls.

8. The floor drain according to claim 1, wherein the connecting element is inserted from above into the channel body in a form-fitting manner.

9. A floor drain installation, comprising:

a subfloor surface having an opening formed therethrough;

a drain flange supported above the subfloor, at least a portion of the drain flange extending through the opening in the subfloor surface and being connectable to a drainage pipe therebelow;

a flange support assembly disposed beneath and supporting the drain flange;

a shower pan tray, substantially circumscribing the flange support assembly;

a waterproofing membrane, extending over the shower pan tray and at least partially over upper surfaces of the drain flange;

a channel body having a bottom surface, the bottom surface of the channel body extending across the waterproofing membrane, the channel body defining a longitudinal direction having an outflow opening formed in a bottom thereof, the outflow opening positioned above the opening formed through the subfloor; and an outflow fitting arranged below the channel body and fluidly coupling the channel body with the drainage flange.

10. The installation of claim 9, further comprising a removable slat-like connecting element assembly carried by the channel body, the connecting element assembly removably fittable within the channel body over the outflow fitting.

11. The installation of claim 10, wherein the channel body includes one or more connecting bars and wherein the removable connecting element assembly includes a corresponding one or more connecting elements that match in profile the connecting bars.

12. The installation of claim 9, further comprising a removable drain grate carried by the channel body, the drain grate removably fittable within the channel body with a portion of the drain grate covering the outflow fitting.

13. The installation of claim 9, wherein the bottom surface of the channel body extending over the waterproofing membrane is substantially water-tight.

14. The installation of claim 9, further comprising a drain flange waterproofing membrane carried about a perimeter of the drain flange, the drain flange waterproofing membrane sealed to the waterproofing membrane extending across the shower pan tray.

15. The installation of claim 9, wherein the flange support assembly is formed of at least two separable components that can be mated within one another beneath the drain flange.

16. A method of installing a floor drain assembly, comprising:

positioning a drain flange support assembly beneath a drain flange;

positioning the drain flange and support assembly atop an opening formed through a subfloor, the drain flange being connectable through the opening to a drainage pipe;

at least partially circumscribing the drain flange support assembly with a shower pan tray;

installing waterproofing membrane across the shower pan tray, the waterproofing membrane extending at least partially across upper surfaces of the drain flange;

positioning an outflow fitting in fluid communication with an outflow opening formed in a channel body;

positioning a bottom surface of the channel body above an upper surface of the waterproofing membrane such that the channel body extends outwardly from the drain flange and above the waterproofing membrane and the shower pan tray;

positioning a debris screen within the channel body over the outflow opening in the channel body.

17. The method of claim 16, wherein positioning the debris screen comprises positioning a slat-like connecting element assembly adjacent one or more connecting bars carried by the channel body.

18. The method of claim 16, wherein positioning the debris screen comprises positioning an elongate drain grate within the channel body, the drain grate extending along substantially an entire length of the channel body.

19. The method of claim 16, wherein installing waterproofing membrane comprises sealing a sheet of waterproofing membrane to a collar of waterproofing membrane carried by the drain flange.

20. The method of claim 16, wherein positioning the drain flange support assembly comprises mating at least two drain flange support assembly components around a portion of the drain flange.

* * * * *